US007362280B2

(12) United States Patent
Shtrom et al.

(10) Patent No.: US 7,362,280 B2
(45) Date of Patent: Apr. 22, 2008

(54) SYSTEM AND METHOD FOR A MINIMIZED ANTENNA APPARATUS WITH SELECTABLE ELEMENTS

(75) Inventors: Victor Shtrom, Sunnyvale, CA (US); William S. Kish, Saratoga, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 106 days.

(21) Appl. No.: 11/041,145

(22) Filed: Jan. 21, 2005

(65) Prior Publication Data

US 2006/0038735 A1 Feb. 23, 2006

Related U.S. Application Data

(60) Provisional application No. 60/602,711, filed on Aug. 18, 2004, provisional application No. 60/603,157, filed on Aug. 18, 2004.

(51) Int. Cl.
*H01Q 9/28* (2006.01)
*H01Q 1/48* (2006.01)

(52) U.S. Cl. ..... 343/795; 343/846

(58) Field of Classification Search ..... 343/700 MS, 343/793, 795, 846, 876
See application file for complete search history.

(56) References Cited

U.S. PATENT DOCUMENTS

| | | | |
|---|---|---|---|
| 4,176,356 | A | 11/1979 | Foster et al. |
| 4,193,077 | A | 3/1980 | Greenberg et al. |
| 4,305,052 | A | 12/1981 | Baril et al. |
| 4,814,777 | A | 3/1989 | Monser |
| 5,173,711 | A | 12/1992 | Takeuchi et al. |
| 5,220,340 | A | 6/1993 | Shafai |
| 5,754,145 | A | 5/1998 | Evans |
| 5,767,809 | A | 6/1998 | Chuang et al. |

(Continued)

FOREIGN PATENT DOCUMENTS

| | | |
|---|---|---|
| EP | 0534612 | 3/1993 |

(Continued)

OTHER PUBLICATIONS

U.S. Appl. No. 11/022,080, Victor Shtrom, Circuit Board Having a Peripheral Antenna Apparatus with Selectable Antenna Elements, filed Dec. 23, 2004.

(Continued)

*Primary Examiner*—Shih-Chao Chen
(74) *Attorney, Agent, or Firm*—Carr & Ferrell LLP

(57) ABSTRACT

A system and method for a wireless link to a remote receiver includes a communication device for generating RF and an antenna apparatus for transmitting the RF. The antenna apparatus comprises a plurality of substantially coplanar modified dipoles. Each modified dipole provides gain with respect to isotropic and a horizontally polarized directional radiation pattern. Further, each modified dipole has one or more loading structures configured to decrease the footprint (i.e., the physical dimension) of the modified dipole and minimize the size of the antenna apparatus. The modified dipoles may be electrically switched to result in various radiation patterns. With multiple of the plurality of modified dipoles active, the antenna apparatus may form an omnidirectional horizontally polarized radiation pattern. One or more directors may be included to concentrate the radiation pattern. The antenna apparatus may be conformally mounted to a housing containing the communication device and the antenna apparatus.

24 Claims, 5 Drawing Sheets

U.S. PATENT DOCUMENTS

| | | | | |
|---|---|---|---|---|
| 6,034,638 | A | 3/2000 | Thiel et al. | |
| 6,094,177 | A | 7/2000 | Yamamoto | |
| 6,266,528 | B1 | 7/2001 | Farzaneh | |
| 6,292,153 | B1 | 9/2001 | Aiello et al. | |
| 6,307,524 | B1 * | 10/2001 | Britain | 343/795 |
| 6,326,922 | B1 | 12/2001 | Hegendoerfer | |
| 6,337,628 | B2 | 1/2002 | Campana, Jr. | |
| 6,337,668 | B1 | 1/2002 | Ito et al. | |
| 6,339,404 | B1 | 1/2002 | Johnson et al. | |
| 6,356,242 | B1 | 3/2002 | Ploussios | |
| 6,356,243 | B1 | 3/2002 | Schneider et al. | |
| 6,377,227 | B1 | 4/2002 | Zhu et al. | |
| 6,392,610 | B1 | 5/2002 | Braun et al. | |
| 6,404,386 | B1 | 6/2002 | Proctor, Jr. et al. | |
| 6,407,719 | B1 | 6/2002 | Ohira et al. | |
| 6,445,688 | B1 | 9/2002 | Garces et al. | |
| 6,498,589 | B1 | 12/2002 | Horii | |
| 6,507,321 | B2 | 1/2003 | Oberschmidt et al. | |
| 6,753,814 | B2 * | 6/2004 | Killen et al. | 343/700 MS |
| 6,762,723 | B2 | 7/2004 | Nallo et al. | |
| 6,819,287 | B2 | 11/2004 | Sullivan et al. | |
| 6,876,280 | B2 | 4/2005 | Nakano | |
| 6,961,028 | B2 * | 11/2005 | Joy et al. | 343/895 |
| 6,975,834 | B1 | 12/2005 | Forster | |
| 7,034,770 | B2 | 4/2006 | Yang et al. | |
| 7,064,717 | B2 | 6/2006 | Kaluzni et al. | |
| 2002/0047800 | A1 | 4/2002 | Proctor, Jr. et al. | |
| 2002/0084942 | A1 | 7/2002 | Tsai et al. | |
| 2002/0105471 | A1 | 8/2002 | Kojima et al. | |
| 2002/0158798 | A1 | 10/2002 | Chiang et al. | |
| 2003/0030588 | A1 | 2/2003 | Kalis et al. | |
| 2003/0122714 | A1 | 7/2003 | Wannagot et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017860 | A1 | 1/2004 | Liu | |
| 2004/0027291 | A1 | 2/2004 | Zhang et al. | |
| 2004/0027304 | A1 | 2/2004 | Chiang et al. | |
| 2004/0032378 | A1 | 2/2004 | Volman et al. | |
| 2004/0036651 | A1 | 2/2004 | Toda | |
| 2004/0036654 | A1 | 2/2004 | Hsieh | |
| 2004/0041732 | A1 | 3/2004 | Aikawa et al. | |
| 2004/0048593 | A1 | 3/2004 | Sano | |
| 2004/0058690 | A1 | 3/2004 | Ratzel et al. | |
| 2004/0061653 | A1 | 4/2004 | Webb et al. | |
| 2004/0070543 | A1 | 4/2004 | Masaki | |
| 2004/0080455 | A1 | 4/2004 | Lee | |
| 2004/0095278 | A1 | 5/2004 | Kanemoto et al. | |
| 2004/0114535 | A1 | 6/2004 | Hoffmann et al. | |

FOREIGN PATENT DOCUMENTS

| | | |
|---|---|---|
| WO | WO 03/079484 | 9/2003 |

OTHER PUBLICATIONS

U.S. Appl. No. 11/010,076, Victor Shtrom, System and Method for an Omnidirectional Planar Antenna Apparatus with Selectable Elements, filed Dec. 9, 2004.

* cited by examiner

SYSTEM AND METHOD FOR A MINIMIZED ANTENNA APPARATUS WITH SELECTABLE ELEMENTS

CROSS-REFERENCE TO RELATED APPLICATIONS

This application claims the benefit of U.S. Provisional Application No. 60/602,711 titled "Planar Antenna Apparatus for Isotropic Coverage and QoS Optimization in Wireless Networks," filed Aug. 18, 2004; and U.S. Provisional Application No. 60/603,157 titled "Software for Controlling a Planar Antenna Apparatus for Isotropic Coverage and QoS Optimization in Wireless Networks," filed Aug. 18, 2004, which are hereby incorporated by reference.

BACKGROUND OF INVENTION

1. Field of the Invention

The present invention relates generally to wireless communications, and more particularly to a system and method for a horizontally polarized antenna apparatus with selectable elements.

2. Description of the Prior Art

In communications systems, there is an ever-increasing demand for higher data throughput, and a corresponding drive to reduce interference that can disrupt data communications. For example, in an IEEE 802.11 network, an access point (i.e., base station) communicates data with one or more remote receiving nodes (e.g., a network interface card) over a wireless link. The wireless link may be susceptible to interference from other access points and stations (nodes), other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One solution for reducing interference in the wireless link between the access point and the remote receiving node is to provide several omnidirectional antennas, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space. Typical solutions for creating horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point. Yet another problem is that the access point with the typical omnidirectional antennas is a relatively large physically, because the omnidirectional antennas extend from the housing.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another solution to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF INVENTION

An antenna apparatus comprises a substrate having a first side and a second side substantially parallel to the first side. Each of a plurality of antenna elements on the first side are configured to be selectively coupled to a communication device to form a first portion of a modified dipole. A ground component on the second side is configured to form a second portion of the modified dipole. Each modified dipole has one or more loading structures configured to decrease the footprint of the modified dipole and produce a directional radiation pattern with polarization substantially in the plane of the substrate.

In some embodiments, the plurality of antenna elements may produce an omnidirectional radiation pattern when two or more of the antenna elements are coupled to the communication device. The antenna apparatus may further comprise an antenna element selector coupled to each antenna element to selectively couple each antenna element to the communication device. The antenna apparatus maintains an impedance match with less than 10 dB return loss when more than one antenna element is coupled to the communication device. A combined radiation pattern resulting from two or more antenna elements being coupled to the communication device may be more directional or less directional than the radiation pattern of a single antenna element.

An antenna apparatus comprises a plurality of substantially coplanar modified dipoles, each modified dipole having one or more loading structures configured to decrease the footprint of the modified dipole. The plurality of modified dipoles may be configured to produce an omnidirectional radiation pattern substantially in the plane of the coplanar modified dipoles. The plurality of modified dipoles may comprise radio frequency conducting material configured to be conformally mounted to a housing containing the antenna apparatus.

A system comprises an antenna apparatus and a communication device. The antenna apparatus is configured to receive and transmit a radio frequency signal, and comprises a plurality of substantially coplanar modified dipoles. Each modified dipole has one or more loading structures configured to decrease the footprint of the modified dipole. The communication device is coupled to the antenna apparatus, and is configured to communicate the radio frequency signal.

A method comprises generating the radio frequency signal in the communication device and radiating the radio frequency signal with the antenna apparatus. The method may comprise coupling two or more of the plurality of modified dipoles to the communication device to result in a substantially omnidirectional radiation pattern. The method may further comprise coupling two or more of the plurality of minimized antenna elements to the communication device to result in a directional radiation pattern. The method may also comprise concentrating the radiation pattern of one or more of the modified dipoles with one or more directors.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

A system for a wireless (i.e., radio frequency or RF) link to a remote receiving device includes a communication device for generating an RF signal and an antenna apparatus for transmitting and/or receiving the RF signal. The antenna apparatus comprises a plurality of substantially coplanar modified dipoles. Each modified dipole provides gain (with respect to isotropic) and a horizontally polarized directional radiation pattern. Further, each modified dipole has one or more loading structures configured to decrease the footprint (i.e., the physical dimension) of the modified dipole and minimize the size of the antenna apparatus. With all or a portion of the plurality of modified dipoles active, the antenna apparatus forms an omnidirectional horizontally polarized radiation pattern.

Advantageously, the loading structures decrease the size of the antenna apparatus, and allow the system to be made smaller. The antenna apparatus is easily manufactured from common planar substrates such as an FR4 printed circuit board (PCB). Further, the antenna apparatus may be integrated into or conformally mounted to a housing of the system, to minimize cost and size of the system, and to provide support for the antenna apparatus.

As described further herein, a further advantage is that the directional radiation pattern of the antenna apparatus is horizontally polarized, substantially in the plane of the antenna elements. Therefore, RF signal transmission indoors is enhanced as compared to a vertically polarized antenna.

In some embodiments, the modified dipoles comprise individually selectable antenna elements. In these embodiments, each antenna element may be electrically selected (e.g., switched on or off) so that the antenna apparatus may form a configurable radiation pattern. If all elements are switched on, the antenna apparatus forms an omnidirectional radiation pattern. In some embodiments, if two or more of the elements is switched on, the antenna apparatus may form a substantially omnidirectional radiation pattern. In such embodiments, the system may select a particular configuration of antenna elements that minimizes interference over the wireless link to the remote receiving device. If the wireless link experiences interference, for example due to other radio transmitting devices, or changes or disturbances in the wireless link between the system and the remote receiving device, the system may select a different configuration of selected antenna elements to change the resulting radiation pattern and minimize the interference. The system may select a configuration of selected antenna elements corresponding to a maximum gain between the system and the remote receiving device. Alternatively, the system may select a configuration of selected antenna elements corresponding to less than maximal gain, but corresponding to reduced interference in the wireless link.

Figure 1:
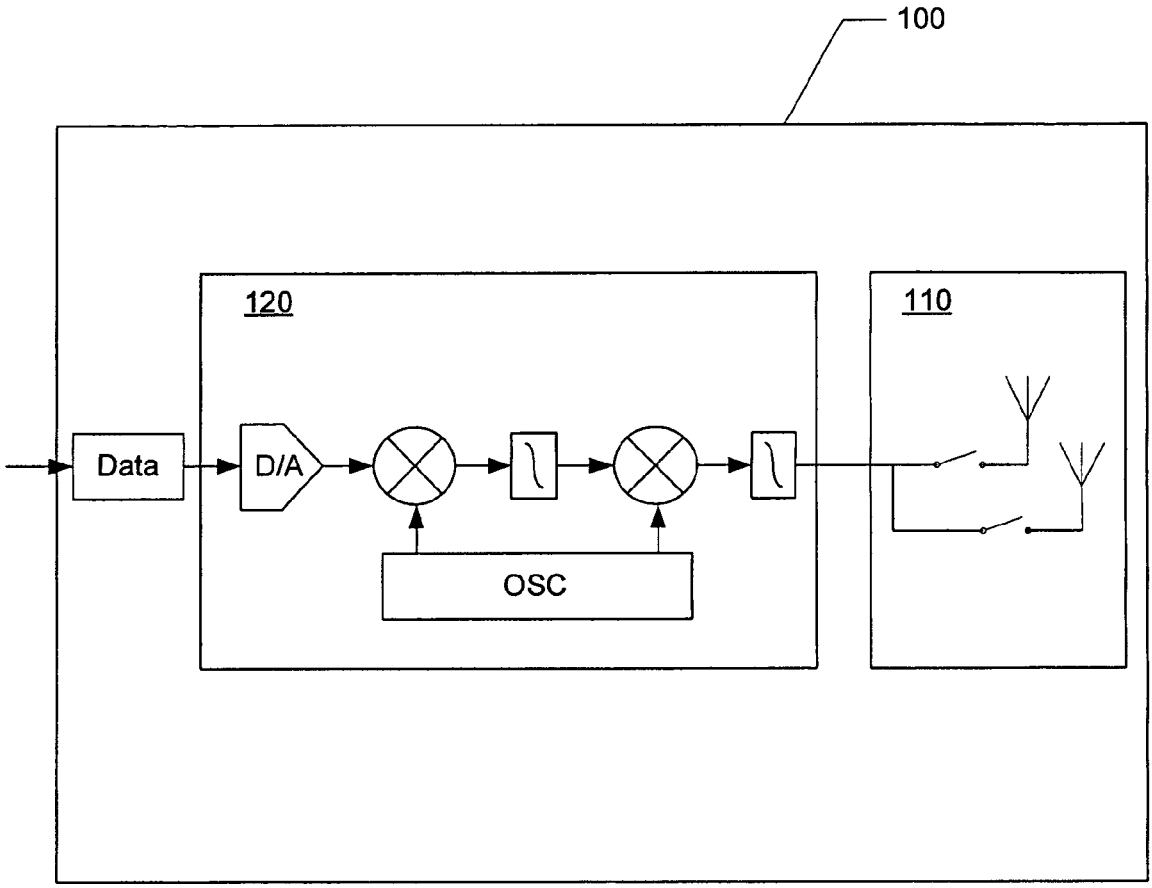
FIG. 1 illustrates a system comprising a horizontally polarized antenna apparatus with selectable elements, in one embodiment in accordance with the present invention.

FIG. 1 illustrates a system 100 comprising a horizontally polarized antenna apparatus with selectable elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, a Voice Over Internet telephone and a remote terminal such as a handheld gaming device. In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the antenna apparatus, the system 100 may also receive data from the remote receiving node via the antenna apparatus.

The system 100 includes a communication device 120 (e.g., a transceiver) and an antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, for example, the communication device 120 comprises well-known circuitry for receiving data packets of video from the router and circuitry for converting the data packets into 802.11 compliant RF signals.

As described further herein, the antenna apparatus 110 comprises a plurality of modified dipoles. Each of the antenna elements provides gain (with respect to isotropic) and a horizontally polarized directional radiation pattern.

In embodiments with individually selectable antenna elements, each antenna element may be electrically selected (e.g., switched on or off) so that the antenna apparatus 110 may form a configurable radiation pattern. The antenna apparatus 110 may include an antenna element selecting device configured to selectively couple one or more of the antenna elements to the communication device 120.

Figure 2A:
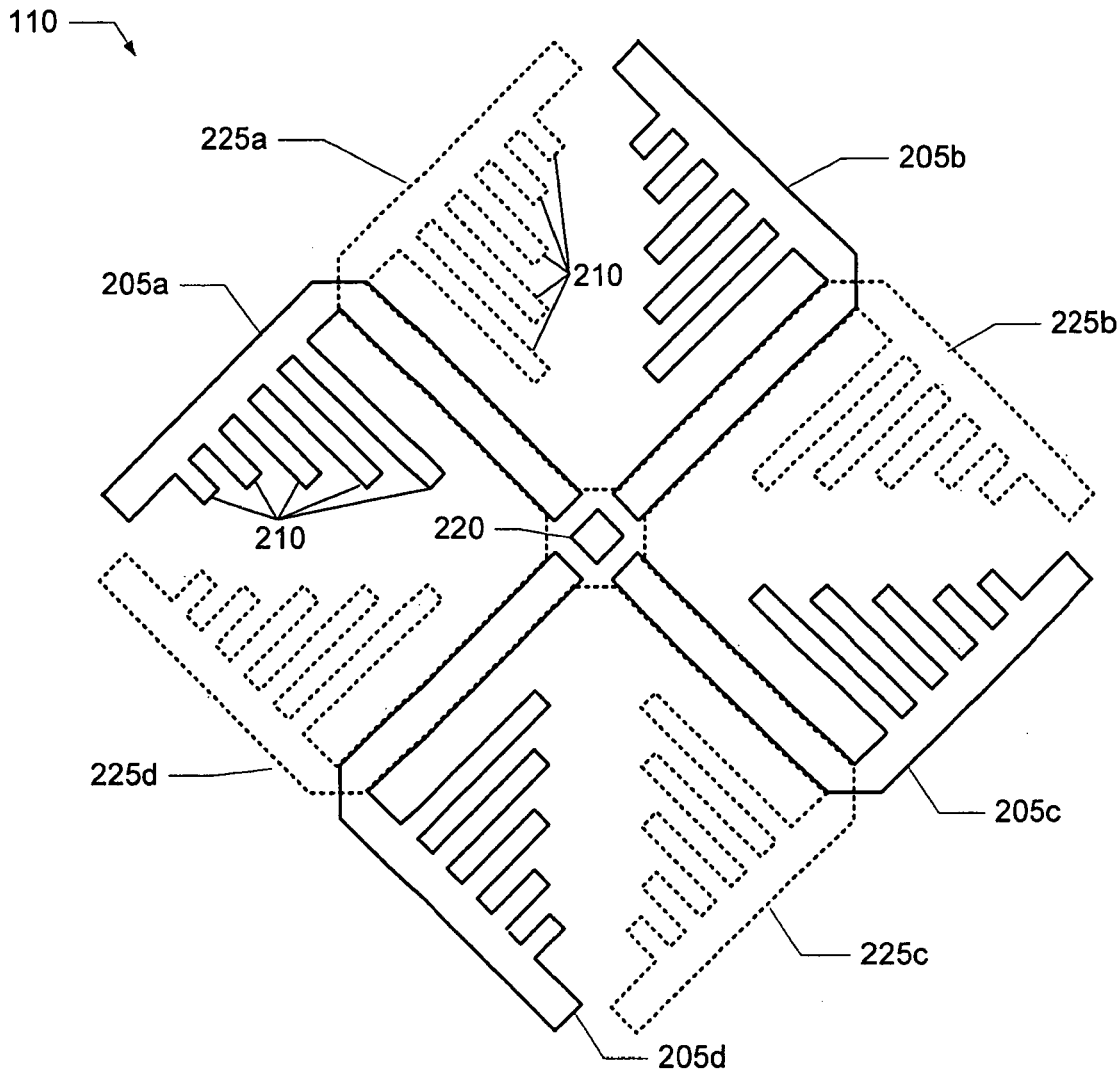
FIG. 2A illustrates the antenna apparatus of FIG. 1, in one embodiment in accordance with the present invention.

FIG. 2A illustrates the antenna apparatus 110 of FIG. 1, in one embodiment in accordance with the present invention. The antenna apparatus 110 of this embodiment includes a substrate (considered as the plane of FIG. 2A) having a first side (depicted as solid lines 205) and a second side (depicted as dashed lines 225) substantially parallel to the first side. In some embodiments, the substrate comprises a PCB such as FR4, Rogers 4003, or other dielectric material.

On the first side of the substrate, depicted by solid lines, the antenna apparatus 110 of FIG. 2A includes a radio frequency feed port 220 and four antenna elements 205*a*-205*d*. Although four modified dipoles (i.e., antenna elements) are depicted, more or fewer antenna elements are contemplated. Although the antenna elements 205*a*-205*d* of FIG. 2A are oriented substantially to edges of a square shaped substrate so as to minimize the size of the antenna apparatus 110, other shapes are contemplated. Further, although the antenna elements 205*a*-205*d* form a radially symmetrical layout about the radio frequency feed port 220, a number of non-symmetrical layouts, rectangular layouts, and layouts symmetrical in only one axis, are contemplated. Furthermore, the antenna elements 205*a*-205*d* need not be of identical dimension, although depicted as such in FIG. 2A.

On the second side of the substrate, depicted as dashed lines in FIG. 2A, the antenna apparatus 110 includes a ground component 225. It will be appreciated that a portion (e.g., the portion 225*a*) of the ground component 225 is configured to form a modified dipole in conjunction with the antenna element 205*a*. As will be apparent to one of ordinary skill, the dipole is completed for each of the antenna elements 205*a*-205*d* by respective conductive traces 225*a*-225*d* extending in mutually-opposite directions. The resultant modified dipole provides a horizontally polarized directional radiation pattern (i.e., substantially in the plane of the antenna apparatus 110), as described further with respect to FIG. 3.

To minimize or reduce the size of the antenna apparatus 110, each of the modified dipoles (e.g. the antenna element 205*a* and the portion 225*a* of the ground component 225) incorporates one or more loading structures 210. For clarity of illustration, only the loading structures 210 for the modified dipole formed from the antenna element 205*a* and the portion 225*a* are numbered in FIG. 2A. The loading structure 210 is configured to slow down electrons, changing the resonance of each modified dipole, thereby making the modified dipole electrically shorter. In other words, at a given operating frequency, providing the loading structures 210 allows the dimension of the modified dipole to be reduced. Providing the loading structures 210 for all of the modified dipoles of the antenna apparatus 110 minimizes the size of the antenna apparatus 110.

Figure 2B:
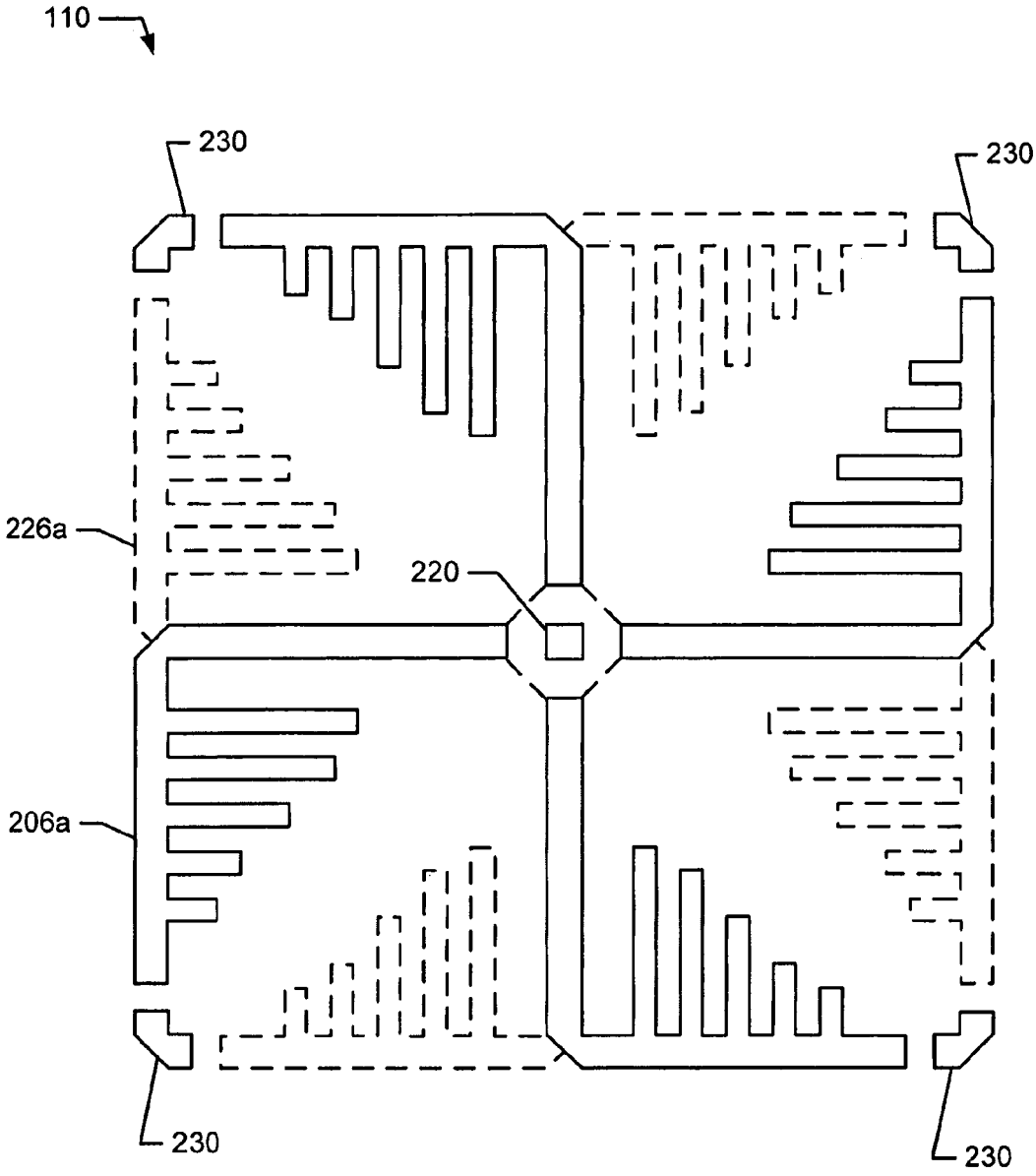
FIG. 2B illustrates the antenna apparatus of FIG. 1, in an alternative embodiment in accordance with the present invention.

FIG. 2B illustrates the antenna apparatus 110 of FIG. 1, in an alternative embodiment in accordance with the present invention. The antenna apparatus 110 of this embodiment includes one or more directors 230. The directors 230 comprise passive elements that constrain the directional radiation pattern of the modified dipoles formed by antenna elements 206*a*-206*d* in conjunction with portions 226*a*-226*d* of the ground component (only 206*a* and 226*a* labeled, for clarity). Because of the directors 230, the antenna elements 206 and the portions 226 are slightly different in configuration than the antenna elements 205 and portions 225 of FIG. 2A. In one embodiment, providing a director 230 for each of the antenna elements 206*a*-206*d* yields an additional about 1 dB of gain for each dipole. It will be appreciated that the directors 230 may be placed on either side of the substrate. It will also be appreciated that additional directors (not shown) may be included to further constrain the directional radiation pattern of one or more of the modified dipoles.

Figure 2C:
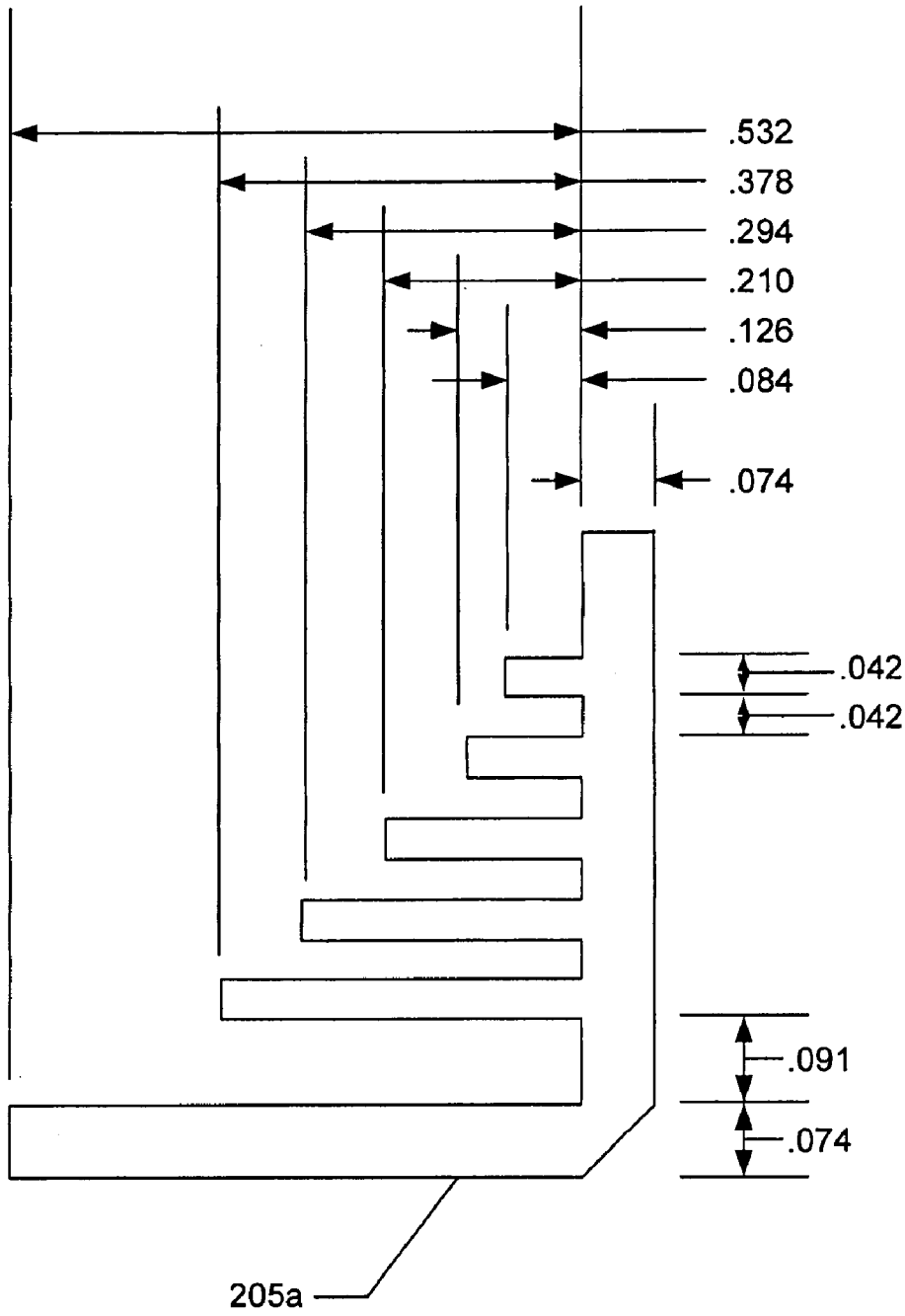
FIG. 2C illustrates dimensions for one antenna element of the antenna apparatus of FIG. 2A, in one embodiment in accordance with the present invention.

FIG. 2C illustrates dimensions for one antenna element of the antenna apparatus 110 of FIG. 2A, in one embodiment in accordance with the present invention. It will be appreciated that the dimensions of individual components of the antenna apparatus 110 (e.g., the antenna element 205*a* and the portion 225*a*) depend upon a desired operating frequency of the antenna apparatus 110. The dimensions of the individual components may be established by use of RF simulation software, such as IE3D from Zeland Software of Fremont, Calif. For example, the antenna apparatus 110 incorporating the components of dimension according to FIG. 2C is designed for operation near 2.4 GHz, based on a substrate PCB of Rogers 4003 material, but it will be appreciated by an antenna designer of ordinary skill that a different substrate having different dielectric properties, such as FR4, may require different dimensions than those shown in FIG. 2C.

Referring to FIGS. 2A and 2B, the radio frequency feed port 220 is configured to receive an RF signal from and/or transmit an RF signal to the communication device 120 of FIG. 1. In some embodiments, an antenna element selector (not shown) may be used to couple the radio frequency feed port 220 to one or more of the antenna elements 205. The antenna element selector may comprise an RF switch (not shown), such as a PIN diode, a GaAs FET, or virtually any RF switching device.

In the embodiment of FIG. 2A, the antenna element selector comprises four PIN diodes, each PIN diode connecting one of the antenna elements 205*a*-205*d* to the radio frequency feed port 220. In this embodiment, the PIN diode comprises a single-pole single-throw switch to switch each antenna element either on or off (i.e., couple or decouple each of the antenna elements 205*a*-205*d* to the radio frequency feed port 220). In one embodiment, a series of control signals (not shown) is used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 220 and the PIN diodes of the antenna element selector are on the side of the substrate with the antenna elements 205*a*-205*d*, however, other embodiments separate the radio frequency feed port 220, the antenna element selector, and the antenna elements 205*a*-205*d*. In some embodiments, one or more light emitting diodes (not shown) are coupled to the antenna element selector as a visual indicator of which of the antenna elements 205*a*-205*d* is on or off. In one embodiment, a light emitting diode is placed in circuit with the PIN diode so that the light emitting diode is lit when the corresponding antenna element 205 is selected.

In some embodiments, the antenna components (e.g., the antenna elements 205*a*-205*d*, the ground component 225, and the directors 210) are formed from RF conductive material. For example, the antenna elements 205*a*-205*d* and the ground component 225 may be formed from metal or other RF conducting material. Rather than being provided on opposing sides of the substrate as shown in FIGS. 2A and 2B, each antenna element 205*a*-205*d* is coplanar with the ground component 225. In some embodiments, the antenna components may be conformally mounted to the housing of the system 100. In such embodiments, the antenna element selector comprises a separate structure (not shown) from the antenna elements 205*a*-205*d*. The antenna element selector may be mounted on a relatively small PCB, and the PCB may be electrically coupled to the antenna elements 205*a*-205*d*. In some embodiments, the switch PCB is soldered directly to the antenna elements 205*a*-205*d*.

In an exemplary embodiment for wireless LAN in accordance with the IEEE 802.11 standard, the antenna apparatus 110 is designed to operate over a frequency range of about 2.4 GHz to 2.4835 GHz. With all four antenna elements 205*a*-205*d* selected to result in an omnidirectional radiation pattern, the combined frequency response of the antenna apparatus 110 is about 90 MHz. In some embodiments, coupling more than one of the antenna elements 205*a*-205*d* to the radio frequency feed port 220 maintains a match with less than 10 dB return loss over 802.11 wireless LAN frequencies, regardless of the number of antenna elements 205*a*-205*d* that are switched on.

Figure 3:
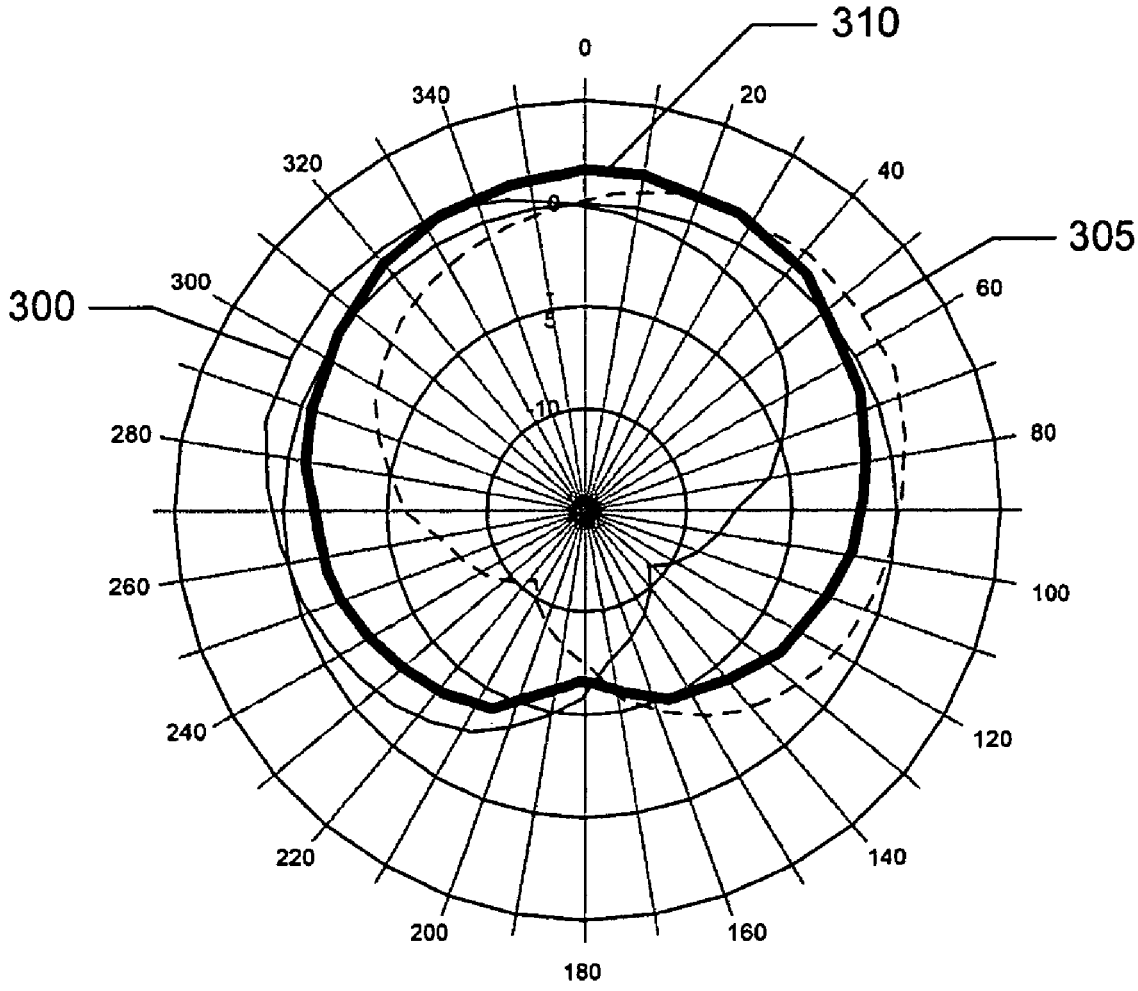
FIG. 3 illustrates various radiation patterns resulting from selecting different antenna elements of the antenna apparatus of FIG. 2, in one embodiment in accordance with the present invention.

FIG. 3 illustrates various radiation patterns resulting from selecting different antenna elements of the antenna apparatus 110 of FIG. 2A, in one embodiment in accordance with the present invention. FIG. 3 depicts the radiation pattern in azimuth (e.g., substantially in the plane of the substrate of FIG. 2A). A generally cardioid directional radiation pattern 300 results from selecting a single antenna element (e.g., the antenna element 205*a*). As shown, the antenna element 205*a* alone yields approximately 2 dBi of gain. A similar directional radiation pattern 305, offset by approximately 90 degrees from the radiation pattern 300, results from selecting an adjacent antenna element (e.g., the antenna element 205*b*). A combined radiation pattern 310 results from selecting the two adjacent antenna elements 205*a* and 205*b*. In this embodiment, enabling the two adjacent antenna elements 205*a* and 205*b* results in higher directionality in azimuth as compared to selecting either of the antenna elements 205*a* or 205*b* alone. Further, the combined radiation pattern 310 of the antenna elements 205*a* and 205*b* is offset in direction from the radiation pattern 300 of the antenna element 205*a* alone and the radiation pattern 305 of the antenna element 205*b* alone.

The radiation patterns 300, 305, and 310 of FIG. 3 in azimuth illustrate how the selectable antenna elements 205*a*-205*d* may be combined to result in various radiation patterns for the antenna apparatus 110. As shown, the combined radiation pattern 310 resulting from two or more adjacent antenna elements (e.g., the antenna element 205*a* and the antenna element 205*b*) being coupled to the radio frequency feed port is more directional than the radiation pattern of a single antenna element.

Not shown in FIG. 3 for improved legibility, is that the selectable antenna elements 205*a*-205*d* may be combined to result in a combined radiation pattern that is less directional than the radiation pattern of a single antenna element. For example, selecting all of the antenna elements 205*a*-205*d* results in a substantially omnidirectional radiation pattern that has less directionality than the directional radiation pattern of a single antenna element. Similarly, selecting two or more antenna elements (e.g., the antenna element 205*a* and the antenna element 205*c* oriented opposite from each other) may result in a substantially omnidirectional radiation pattern. In this fashion, selecting a subset of the antenna elements 205*a*-205*d*, or substantially all of the antenna elements 205*a*-205*d*, may result in a substantially omnidirectional radiation pattern for the antenna apparatus 110. Although not shown in FIG. 3, it will be appreciated that directors 230 may further constrain the directional radiation pattern of one or more of the antenna elements 205*a*-205*d* in azimuth.

FIG. 3 also shows how the antenna apparatus 110 may be advantageously configured, for example, to reduce interference in the wireless link between the system 100 of FIG. 1 and a remote receiving node. For example, if the remote receiving node is situated at zero degrees in azimuth relative to the system 100 (considered to be at the center of FIG. 3), the antenna element 205*a* corresponding to the radiation pattern 300 yields approximately the same gain in the direction of the remote receiving node as the antenna element 205*b* corresponding to the radiation pattern 305. However, as can be seen by comparing the radiation pattern 300 and the radiation pattern 305, if an interferer is situated at twenty degrees of azimuth relative to the system 100, selecting the antenna element 205*a* yields a signal strength reduction for the interferer as opposed to selecting the antenna element 205*b*. Advantageously, depending on the signal environment around the system 100, the antenna apparatus 110 may be configured to reduce interference in the wireless link between the system 100 and one or more remote receiving nodes.

Not depicted is an elevation radiation pattern for the antenna apparatus 110 of FIG. 2. The elevation radiation pattern is substantially in the plane of the antenna apparatus 110. Although not shown, it will be appreciated that the directors 230 may advantageously further constrain the radiation pattern of one or more of the antenna elements 205*a*-205*d* in elevation. For example, in some embodiments, the system 110 may be located on a floor of a building to establish a wireless local area network with one or more remote receiving nodes on the same floor. Including the directors 230 in the antenna apparatus 110 further constrains the wireless link to substantially the same floor, and minimizes interference from RF sources on other floors of the building.

An advantage of the antenna apparatus 110 is that due to the loading elements 210, the antenna apparatus 110 is reduced in size. Accordingly, the system 100 comprising the antenna apparatus 110 may be reduced in size. Another advantage is that the antenna apparatus 110 may be constructed on PCB so that the entire antenna apparatus 110 can be easily manufactured at low cost. One embodiment or layout of the antenna apparatus 110 comprises a square or rectangular shape, so that the antenna apparatus 110 is easily panelized.

A further advantage is that, in some embodiments, the antenna elements 205 are each selectable and may be switched on or off to form various combined radiation patterns for the antenna apparatus 110. For example, the system 100 communicating over the wireless link to the remote receiving node may select a particular configuration of selected antenna elements 205 that minimizes interference over the wireless link. If the wireless link experiences interference, for example due to other radio transmitting devices, or changes or disturbances in the wireless link between the system 100 and the remote receiving node, the system 100 may select a different configuration of selected antenna elements 205 to change the radiation pattern of the antenna apparatus 110 and minimize the interference in the wireless link. The system 100 may select a configuration of selected antenna elements 205 corresponding to a maximum gain between the system and the remote receiving node. Alternatively, the system may select a configuration of selected antenna elements 205 corresponding to less than maximal gain, but corresponding to reduced interference. Alternatively, all or substantially all of the antenna elements 205 may be selected to form a combined omnidirectional radiation pattern.

A further advantage of the antenna apparatus 110 is that RF signals travel better indoors with horizontally polarized signals. Typically, network interface cards (NICs) are horizontally polarized. Providing horizontally polarized signals with the antenna apparatus 110 improves interference rejection (potentially, up to 20 dB) from RF sources that use commonly-available vertically polarized antennas.

Another advantage of the system 100 is that the antenna apparatus 110 includes switching at RF as opposed to switching at baseband. Switching at RF means that the communication device 120 requires only one RF up/down converter. Switching at RF also requires a significantly simplified interface between the communication device 120 and the antenna apparatus 110. For example, the antenna apparatus 110 provides an impedance match under all configurations of selected antenna elements, regardless of which antenna elements are selected. In one embodiment, a match with less than 10 dB return loss is maintained under all configurations of selected antenna elements, over the range of frequencies of the 802.11 standard, regardless of which antenna elements are selected.

A still further advantage of the system 100 is that, in comparison for example to a phased array antenna with relatively complex phasing of elements, switching for the antenna apparatus 110 is performed to form the combined radiation pattern by merely switching antenna elements on or off. No phase variation, with attendant phase matching complexity, is required in the antenna apparatus 110.

Yet another advantage of the antenna apparatus 110 on PCB is that the minimized antenna apparatus 110 does not require a 3-dimensional manufactured structure, as would be required by a plurality of "patch" antennas needed to form an omnidirectional antenna.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A selectable antenna element apparatus, comprising:

a substrate having a first side and a second side substantially parallel to the first side;

a plurality of active antenna elements on the first side, each active antenna element configured to be selectively coupled to a communication device to form a first portion of a modified dipole; and a ground component on the second side, the ground component configured to form a second portion of the modified dipole, each modified dipole having one or more loading structures configured to decrease a footprint and change the resonance of the modified dipole, the modified dipole producing an omnidirectional horizontally polarized radiation pattern with polarization substantially in the plane of the substrate.

2. The antenna apparatus of claim 1, wherein the plurality of active antenna elements produce the omnidirectional radiation pattern when two or more of the antenna elements are coupled to the communication device.

3. The antenna apparatus of claim 1, wherein the ground component configured to form the second portion of the modified dipole is on the same side of the substrate as the first portion of the modified dipole.

4. The antenna apparatus of claim 1, further comprising an antenna element selector coupled to each active antenna element, the antenna element selector configured to selectively couple each active antenna element to the communication device.

5. The antenna apparatus of claim 4, wherein the antenna element selector comprises a PIN diode.

6. The antenna apparatus of claim 4, wherein the antenna element selector comprises a single pole single throw RF switch.

7. The antenna apparatus of claim 4, further comprising a visual indicator coupled to the antenna element selector, the visual indicator configured to indicate which of the active antenna elements is selectively coupled to the communication device.

8. The antenna apparatus of claim 1, wherein a match with less than 10 dB return loss is maintained when one or more active antenna elements are coupled to the communication device.

9. The antenna apparatus of claim 1, wherein the substrate comprises a substantially rectangular dielectric sheet and each of the modified dipoles is oriented substantially parallel to edges of the substrate.

10. The antenna apparatus of claim 1, wherein the substrate comprises a printed circuit board.

11. The antenna apparatus of claim 1, further comprising one or more directors configured to concentrate the directional radiation pattern.

12. The antenna apparatus of claim 1, wherein a combined radiation pattern resulting from, two or more active antenna elements being selectively coupled to the communication device is more directional than the radiation pattern of a single active antenna element.

13. The antenna apparatus of claim 1, wherein a combined radiation pattern resulting from two or more active, antenna elements being coupled to the communication device is less directional than the radiation pattern of a single active antenna element.

14. A selectable antenna element apparatus comprising a plurality of substantially coplanar modified dipoles, each modified dipole having one or more loading structures configured to decrease a footprint and change the resonance of the modified dipole, wherein the plurality of modified dipoles are configured to produce an omnidirectional horizontally polarized radiation pattern with polarization substantially m the plane of the coplanar modified dipoles; and one or more directors configured to concentrate the radiation pattern of one or more of the modified dipoles.

15. The antenna apparatus of claim 14, wherein the plurality of modified dipoles comprise radio frequency conducting material configured to be conformally mounted to a housing containing the antenna apparatus.

16. The antenna apparatus of claim 14, wherein the plurality of modified dipoles comprise radio frequency conducting material configured to be conformally mounted to the outside of a substrate housing.

17. The antenna apparatus of claim 14, wherein each of the plurality of modified dipoles is configured to be selectively coupled to a communication device.

18. The antenna apparatus of claim 17, further comprising a PIN diode configured to selectively couple each of the plurality of modified dipoles to the communication device.

19. The antenna apparatus of claim 17, wherein a combined radiation pattern resulting from two or more modified dipoles being coupled to the communication device is more directional than the radiation pattern of a single modified dipole.

20. The antenna apparatus of claim 17, wherein a combined radiation pattern resulting from two or more modified dipoles being coupled to the communication device is less directional than the radiation pattern of a single modified dipole.

21. The antenna apparatus of claim 17, wherein a combined radiation pattern resulting from two or more modified dipoles being coupled to the communication device is offset in direction from the radiation pattern of a single modified dipole.

22. The antenna apparatus of claim 17, wherein a match with less than 10 dB return loss is maintained when one or more modified dipoles is coupled to the communication device.

23. A method for receiving and transmitting a radio frequency signal, comprising:

generating a radio frequency signal in a communication device;

radiating the radio frequency signal with an antenna apparatus comprising a plurality of modified dipoles, each modified dipole having one or more loading structures configured to decrease a footprint and change the resonance of the modified dipole;

coupling two or more of the plurality of modified dipoles to the communication device to result in an omnidirectional horizontally polarized radiation pattern with polarization substantially in the plane of the two or more of the plurality of modified dipoles; and concentrating a radiation pattern of one or more of the modified dipoles with one or more directors.

24. The method of claim 23, further comprising coupling two or more of the plurality of modified dipoles to the communication device to result in a directional radiation pattern.

* * * * *